US009605852B2

(12) United States Patent
Porraro

(10) Patent No.: US 9,605,852 B2
(45) Date of Patent: Mar. 28, 2017

(54) ACCESSORY FOR INDICATING STATUS OF STOVE BURNER

(71) Applicant: Matthew L Porraro, Basking Ridge, NJ (US)

(72) Inventor: Matthew L Porraro, Basking Ridge, NJ (US)

( * ) Notice: Subject to any disclaimer, the term of this patent is extended or adjusted under 35 U.S.C. 154(b) by 441 days.

(21) Appl. No.: 14/167,176

(22) Filed: Jan. 29, 2014

(65) Prior Publication Data

US 2014/0208958 A1 Jul. 31, 2014

Related U.S. Application Data

(60) Provisional application No. 61/758,432, filed on Jan. 30, 2013, provisional application No. 61/929,323, filed on Jan. 20, 2014.

(51) Int. Cl.
*F24C 3/12* (2006.01)

(52) U.S. Cl.
CPC ..... *F24C 3/12* (2013.01)

(58) Field of Classification Search
CPC .... F24C 3/12; F24C 7/08; F24C 7/082; Y10T 16/487; Y10T 307/729; Y10T 74/2014; Y10T 74/2084
USPC ..... 126/42; 74/553; 324/207.2
See application file for complete search history.

(56) References Cited

U.S. PATENT DOCUMENTS 1,586,993 A * 6/1926 Hoeschen ..... H01H 29/22 200/204
2,650,274 A * 8/1953 McCammant ..... H01H 29/20 200/220
2,733,759 A * 2/1956 McCammant ..... F24C 3/103 337/310
2,823,638 A * 2/1958 Aylor ..... F24C 7/082 116/202
3,010,383 A * 11/1961 Greene ..... A47J 37/0611 219/524
4,134,358 A * 1/1979 Heermans ..... A47J 27/212 116/137 R
4,199,741 A * 4/1980 Serrus Paulet ..... H01H 36/00 335/206
4,293,837 A * 10/1981 Jaffe ..... G01D 5/147 257/E43.002
4,295,246 A 10/1981 Howie, Jr.
4,419,644 A * 12/1983 Baermann ..... H01F 7/04 335/288
4,446,455 A 5/1984 Nashawaty
(Continued)

FOREIGN PATENT DOCUMENTS

RU 2126936 C1 2/1999

OTHER PUBLICATIONS

International Search Report and Written Opinion of May 15, 2014, PCT/US2014/013723.

*Primary Examiner* — Jorge Pereiro
(74) *Attorney, Agent, or Firm* — Greenberg Traurig, LLP

(57) ABSTRACT

An indicator device for proving an announcement of the status of a burner control knob, A base plate attaches to and rotates with a burner control shaft on a stove. An attitude sensing switch mounted with the base plate changes its conductive state when a burner control shaft moves from an "off" position. An annunciator senses the change in conductive state to initiate an announcement of that event.

20 Claims, 11 Drawing Sheets

(56) References Cited

U.S. PATENT DOCUMENTS 5,608,378 A * 3/1997 McLean ..... G08B 21/24 219/445.1
5,841,428 A * 11/1998 Jaeger ..... G02F 1/13306 345/156
5,936,613 A * 8/1999 Jaeger ..... G06F 3/0238 345/172
6,420,969 B1 7/2002 Campbell
6,446,622 B1 * 9/2002 Home ..... F24C 3/103 126/39 E
6,733,146 B1 5/2004 Vastano
7,069,090 B2 * 6/2006 Huffington ..... G05B 19/104 340/500
7,076,324 B2 * 7/2006 Harkcom ..... G05B 19/104 126/20
7,113,063 B2 * 9/2006 Romanik ..... H01H 36/0033 335/205
7,196,623 B1 * 3/2007 Wang ..... G08B 21/24 340/10.2
7,816,818 B2 10/2010 Sellecchia
8,174,255 B2 * 5/2012 Peterson ..... G01R 33/07 324/207.2
8,322,366 B2 * 12/2012 Sullivan ..... F16K 1/304 137/552.7
8,336,424 B2 * 12/2012 Miret ..... G01D 5/2412 345/156
8,766,910 B2 * 7/2014 Grivna ..... G06F 3/033 345/156
8,796,566 B2 * 8/2014 Kerner ..... H01H 19/11 200/4
8,928,187 B2 * 1/2015 Hamm ..... H01H 19/03 219/482
2005/0068133 A1 * 3/2005 Romanik ..... H01H 36/0033 335/207
2006/0025874 A1 * 2/2006 Huffington ..... G05B 19/104 700/44
2006/0036338 A1 * 2/2006 Harkcom ..... G05B 19/104 700/83
2006/0202848 A1 * 9/2006 Volodarsky ..... F24C 7/082 340/654
2007/0204858 A1 9/2007 Abelbeck
2009/0009491 A1 * 1/2009 Grivna ..... G06F 3/033 345/184
2009/0044381 A1 * 2/2009 Sellecchia ..... F24C 7/08 16/433
2009/0115404 A1 * 5/2009 Peterson ..... G01R 33/07 324/207.2
2009/0273482 A1 * 11/2009 Sullivan ..... F16K 1/304 340/644
2012/0042745 A1 * 2/2012 Hamm ..... H01H 19/03 74/553
2012/0286913 A1 * 11/2012 Fullerton ..... G01D 18/00 335/306
2012/0325197 A1 12/2012 Legaspi
2013/0113465 A1 * 5/2013 Padilla ..... G05G 1/02 324/207.2
2013/0220779 A1 * 8/2013 Kerner ..... H01H 19/11 200/4

* cited by examiner

ACCESSORY FOR INDICATING STATUS OF STOVE BURNER

CROSS-REFERENCES TO RELATED APPLICATIONS

This application is a conversion of co-pending U.S. Provisional Application Ser. No. 61/758,432 filed Feb. 9, 2013 for an Accessory for Visually Indicating Status of Stove Burner and of co-pending U.S. Provisional Application Ser. No. 61/929,323 filed Jan. 20, 2014 for an Accessory for Visually Indicating Status of Stove Burner.

BACKGROUND OF THE INVENTION

Field of the Invention

This invention generally relates to indicator devices and more specifically to an indicator device for installation with a stove burner control shaft for announcing the status of a corresponding burner.

Description of Related Art

Many modern gas and electric stoves contain an integral visual indicator, such as a status light, for displaying the status of each burner. Basically, when a burner is off the visual indicator is off. When the burner is on, the visual indicator produces a readily visible light output. However, many stoves currently in use do not include such integral visual indicators. The ability to retrofit an existing stove with an economical device that provides a visual indication of burner status would be useful particularly if the retrofit were available to a consumer at an economical price and were easy to install and use.

U.S. Pat. No. 6,733,146 (2004) to Vastano discloses an Illuminated Knob for Indicating the Operative Condition of an Appliance. In one embodiment retrofitting existing stoves is accomplished by replacing an existing burner control knob on a control shaft with an entirely new burner control knob that provides illumination as an indication of burner status. This burner control knob has front and rear surfaces and an outer edge that defines an internal battery compartment accessible from the front of the knob. The burner control knob carries a battery, a light emitting diode (LED) that extends radially to the exterior of the knob and an attitude sensing switch. When the burner control knob is in an "off" position, the attitude sensing switch is open and the LED is off Upon rotation of the burner control knob from the off position to any other angular position, the attitude sensing switch closes to energize the LED and produce light.

Although Vastano's device provides a visual indication of burner status, it is integral with a burner control knob and replaces the original burner control knob. Moreover, the operation of Vastano's sensing switch is dependent upon gravity. Conductivity through the switch exists only through about 180° of rotation at which point the conductive material will not contact both sets of switches. Typically, however, a burner control knob and the control shaft rotate through a larger range (e.g., 270°). Also, with this type of switch the burner control shaft must be horizontal to assure that in a reference position and that the conductive material is not in contact with switch terminals when the switch is in the "off" position. The cost of the Vastano's device includes the cost of a support element for an indicating apparatus and an element to provide the tactile function of the original burner control knob. Access to the battery compartment for battery replacement in this replacement burner control knob requires a front element to be removed. The manufacture of such a removable element increases the device complexity and, consequently, its manufacturing cost. In addition, it may be necessary for this implementation to be made in several models to accommodate different stove configurations in the vicinity of the burner control knobs and to accommodate different burner control shaft diameters.

U.S. Pat. No. 7,816,818 to Sellecchia (2010) discloses a Stove Knob Timer Device which includes a main housing for engaging a stove operational or control shaft. When the control shaft rotates to activate a respective stove burner, the timer is actuated. After a predetermined time an annunciator comprising a speaker is activated to prompt a user to monitor the stove and to press a reset button to deactivate the speaker. Failure to press the reset button in a timely manner causes the timer device to emit a more aggressive alarm. When the reset button is pressed, the timer is reset so the burner continues to be energized although the annunciator is silent until the timer interval expires. Sellecchia's device contains many mechanically complex mechanism components that will be expensive to manufacture.

What is needed is a device that provides a visual indication, an audible indication or both of burner status that is adapted for installation on stoves during manufacture and for retrofitting existing stoves, that is adapted for application with burner control shafts extending along horizontal, vertical or intermediate axes, that is economical, that is easy to install on original equipment and as a retrofit, that is easy to use and that can be adapted for use in a variety of different stove configurations.

SUMMARY

Therefore, it is an object of this invention to provide an indicator device that can be retrofitted to a burner control shaft on an existing stove to provide a visual or audible indication of burner status.

Another object of this invention is to provide an indicator device that is easy to use and is adapted for easy installation on a variety of different stoves.

Still another object of this invention is to provide an indicator device that is economical to manufacture.

Yet another object of this invention is to provide an indicator device that is operable with burner control shafts that lie along horizontal, vertical or intermediate axes.

In accordance with one aspect of this invention, an indicating device provides an announcement of rotation of a burner control shaft in a stove from an "off" position to any of a range of angularly displaced positions. A reference mounts on the stove for defining the "off" position of a burner control shaft. The indicating device additionally comprises a control system for indicating angular displacement of the control shaft from the "off" position. This includes a base that attaches to the control shaft for rotation therewith. The base includes an electrically operated annunciator and a battery operated power supply. A switching structure also mounts to the base and connects between the power supply and the annunciator. It establishes an open circuit when a control shaft is at the "off" position whereby the annunciator is inactive and is active when the control shaft is displaced from the "off" position.

In accordance with another aspect of this invention, a burner alert control annunciates rotation of the burner control shaft in the stove from an "off" position to any of a range of angularly displaced positions. A magnet mounts to the stove approximate the burner control shaft in a position corresponding to an "off" position of the burner control shaft. A control system indicates angular displacement of the burner control shaft. It includes a base that attaches to the burner control shaft for rotation therewith and that supports an electrically operated annunciator having at least a portion thereof mounted to the base and a battery operated power supply. A switch mounts on the base whereby the magnet and switch portion on the base are aligned when the burner control shaft is in the "off" position. The switch establishes an open circuit when the burner control shaft is at the "off" position whereby the annunciator is inactive and establishes a closed circuit for activating the annunciator when the burner control shaft is displaced from the "off" position.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
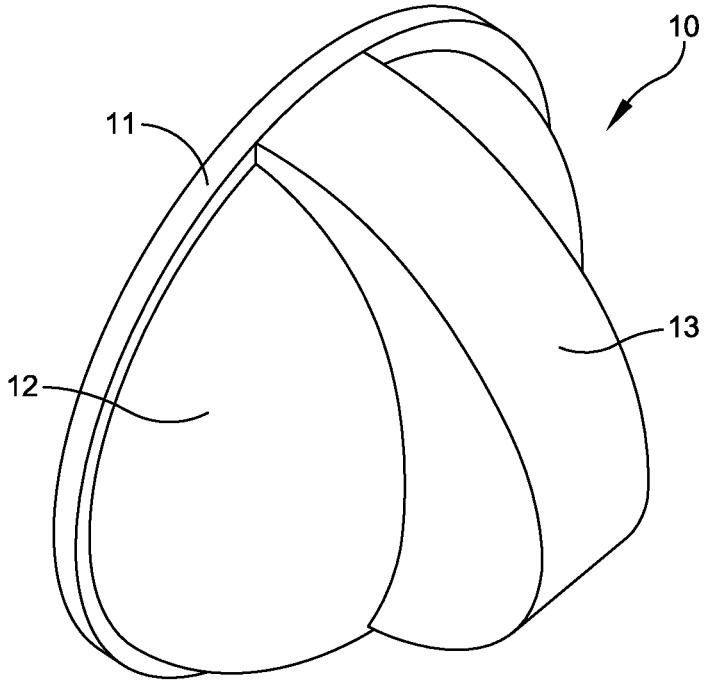
FIG. 1 is a perspective view of a burner control knob and a modification thereto in accordance with one embodiment of this invention.
Figure 2:
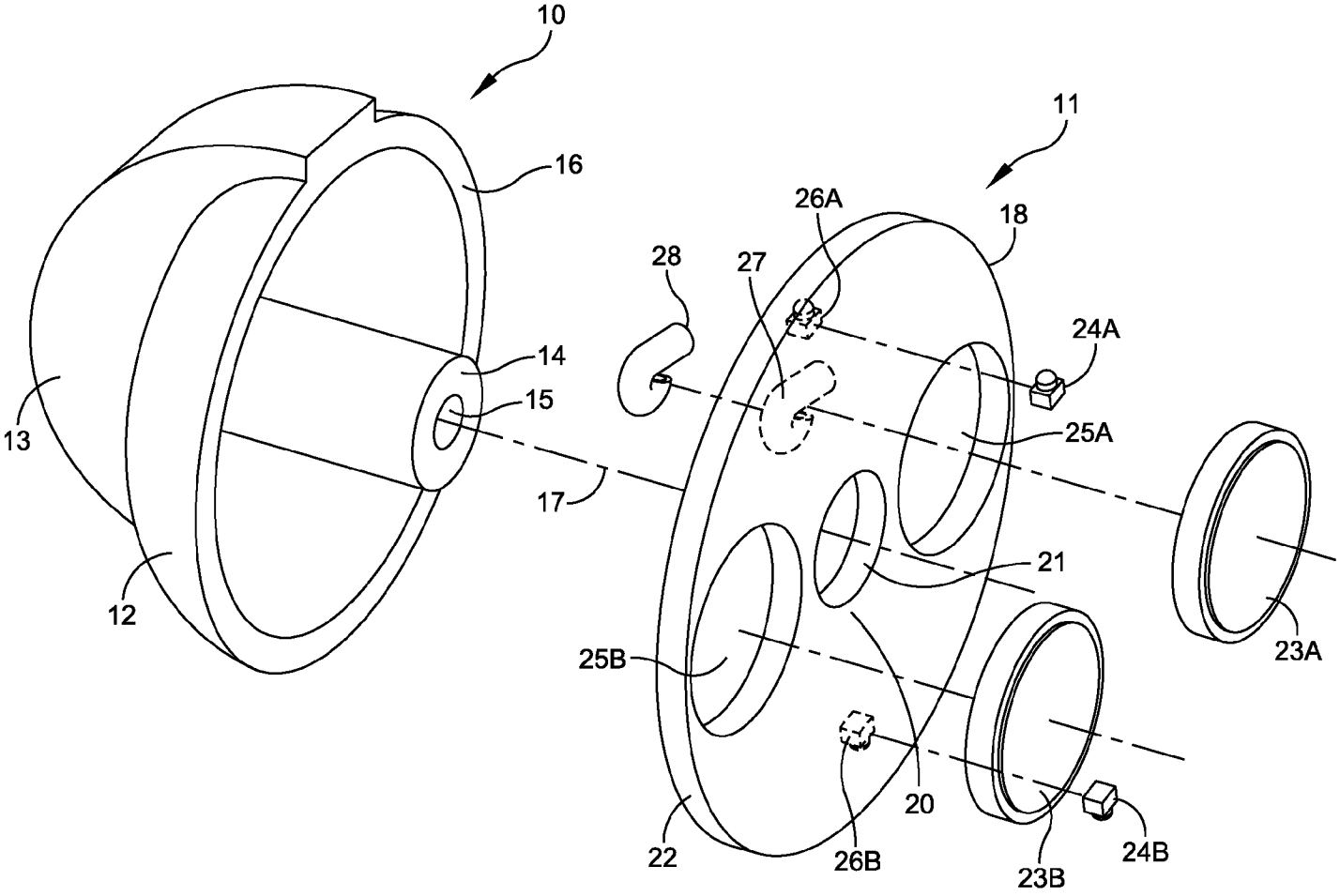
FIG. 2 is an exploded view in perspective of one embodiment of a burner control knob as shown in FIG. 1.

FIGS. 1 and 2 depict an existing burner control knob 10 in an "off" position attached to one embodiment of a retrofit assembly 11. The burner control knob 10 has a body portion 12 that may define an internal cavity and an operator 13. In FIG. 2 this embodiment includes an axially extending bushing 14 that has a central lumen 15 for receiving a burner control shaft (not shown). At the outer perimeter, the burner control knob 10 terminates axially with an annular planar surface 16 that is transverse to an axis of rotation 17 for the burner control shaft. The constructions of this burner control knob and other burner control knobs are known in the art.

Referring to FIG. 2 the retrofit assembly 11 includes a relatively thin, cylindrical planar base plate 18 that is formed of a clear or translucent plastic material. A central portion 20 of the base plate 18 defines a central aperture having an annular surface 21 with a diameter that corresponds to the outer diameter of the bushing 14. This allows the retrofit assembly 11 to be inserted over the bushing 14 and then displaced until it abuts the surface 16, as described in greater detail later. An outer surface 22 has a diameter that typically will correspond to the diameter of the body portion 12 for the burner control knob 10 for aesthetic and cleaning purposes.

In this embodiment, the retrofit assembly base 18 also carries batteries 23A and 23B and light emitting diodes (LEDs) 24A and 24B in recesses or cavities 25A and 25B and 26A and 26B, respectively. Another aperture or recess 27 in the retrofit assembly base 18 carries an angular position sensing, or attitude sensing switch, 28. Typically the attitude sensing switch 28 is displaced radially from the axis 17.

Figure 3:
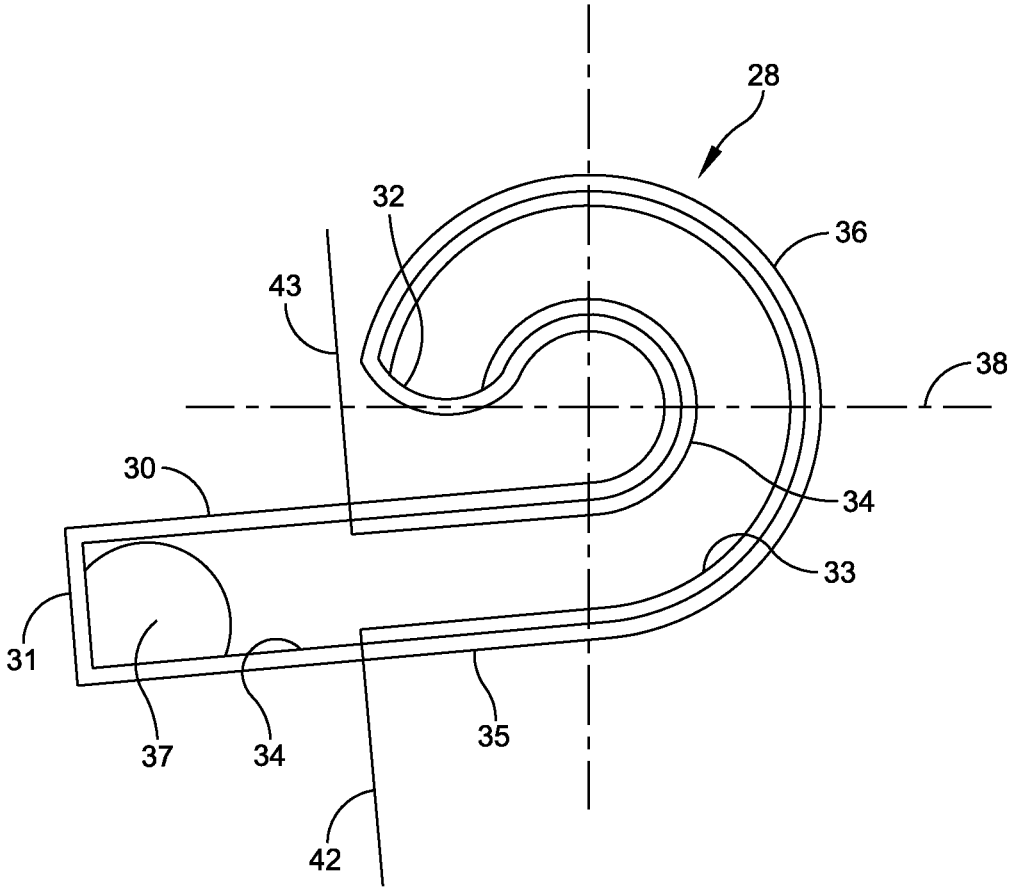
FIG. 3 depicts a switch that is useful in burner control knob of FIG. 2.

FIG. 3 depicts the construction of one embodiment of an attitude sensing switch 28 that responds to the clockwise rotation of a burner control knob from an "off" position in FIG. 3. In this embodiment, the attitude sensing switch 28 comprises a non-conductive tube 30 that extends between two closed ends 31 and 32. The tube carries angularly spaced conductor elements 33 and 34 on the interior of a portion of the non-conductive tube 30 extending continuously from the closed end 32 to a position spaced from the closed end 31. Such conductor elements can be in any of a number of forms including, but not limited to, conductive wire, conductive plating or narrow conductive strips. This assembly, particularly the non-conductive tube 30, extends from the closed end 31 with a linear portion 35 and then through a reverse bend 36 with the non-conductive tube 30 terminating at the closed end 32. A quantity of conductive liquid 37 moves between the ends 31 and 32 in response to gravity and to changes in the orientation of the attitude sensing switch 28.

In the "off" position shown in FIG. 3, the attitude sensing switch 28 is in a position whereby a linear portion 35 lies along an axis that tilts downward toward the end 31 about a horizontal axis 38 so that the conductive liquid 37 gravitates to the closed end 31 and does not contact the conductor elements 33 and 34 to present an open circuit. As the burner control knob rotates, the orientation of the linear portion 35 rotates to tilt downward away from the closed end 31. During this rotation, the conductive liquid 37 gravitates into contact with the conductor strips 33 and 34 to close the circuit therebetween. After about 90° of rotation of the burner control shaft about a horizontal axis 7, the conductive liquid 37 is stably located and cannot return to the closed end 31, so the attitude sensing switch 28 remains closed. Further rotation to a full "on" position (about 270° from the position in FIG. 3) causes the conductive liquid 37 to advance to the closed end 32 so the attitude sensing switch 28 remains in a closed state. Thus, the attitude sensing switch 28 is in a closed, or conductive, state at all positions other than the "off" position of the burner control knob and shaft.

Figure 4:
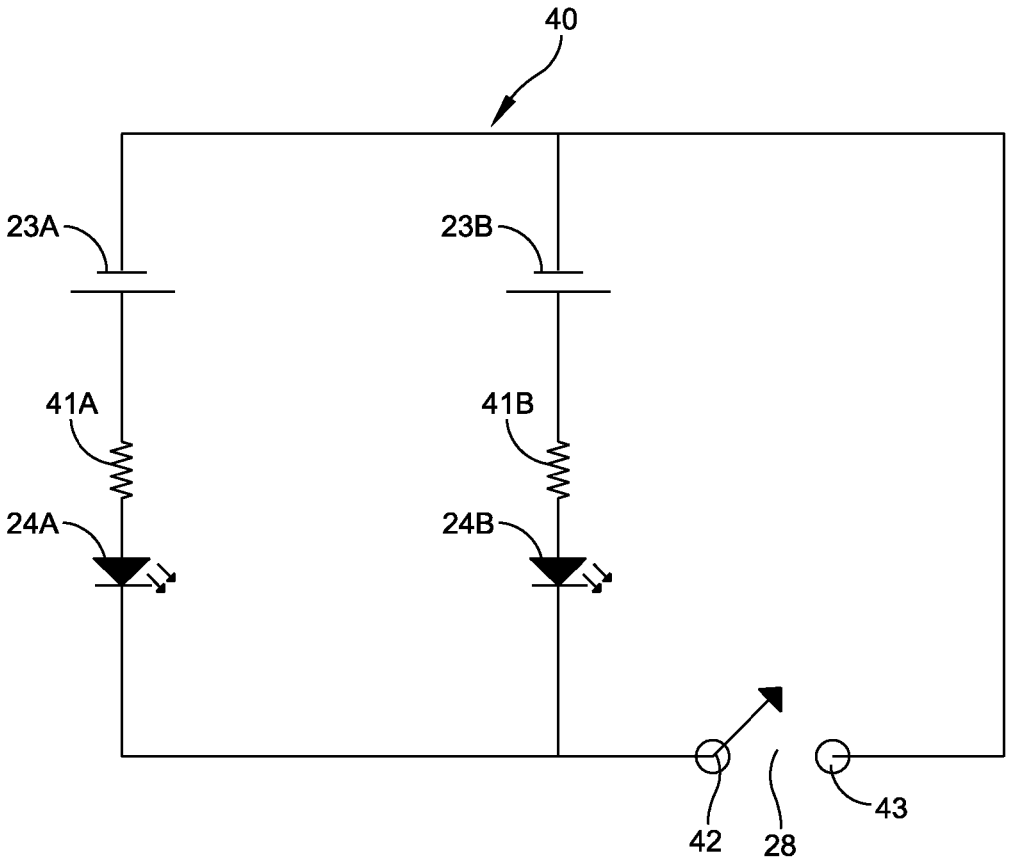
FIG. 4 schematically depicts one embodiment of an electrical circuit for implementing the embodiment of the invention shown in FIG. 2.

FIG. 4 is a schematic of one embodiment of a circuit 40 for use in the retrofit assembly base plate 18 that provides the visual indication of burner status. This circuit includes two legs in parallel. The first leg includes a series circuit of the battery 23A and a resistor 41A that form a first battery operated power supply for the LED 24A; the second leg, includes the battery 23B and a resistor 41B that form a second battery operated power supply for an LED 24B. These two legs then connect through the attitude sensing switch 28 with terminals 42 and 43 that is positioned to be in the open state when the retrofit assembly base 18 is an "off" position. When the retrofit assembly base 18 rotates from the "off" position, the attitude sensing switch 28 closes to establish current paths through the LED's 24A and 24B. Each LED then emits light which disperses outwardly from the LED through the transparent or translucent base plate 18 thereby to provide a clear visual indication that the burner control shaft is no longer in the "off" position.

As will be apparent, this embodiment of the invention meets several of the objectives of this invention. This indicator device that can be retrofitted to a horizontal burner control shaft on an existing stove to provide a visual annunciation of burner status. It is easy to use, is adapted for easy installation on a variety of different stoves and is economical to manufacture. However, it is limited to use with burners with horizontal burner control shafts. If a burner control shaft is not horizontal, the resulting switch orientation may not permit continuous switch conductivity through the range of control shaft motion.

Figure 5:
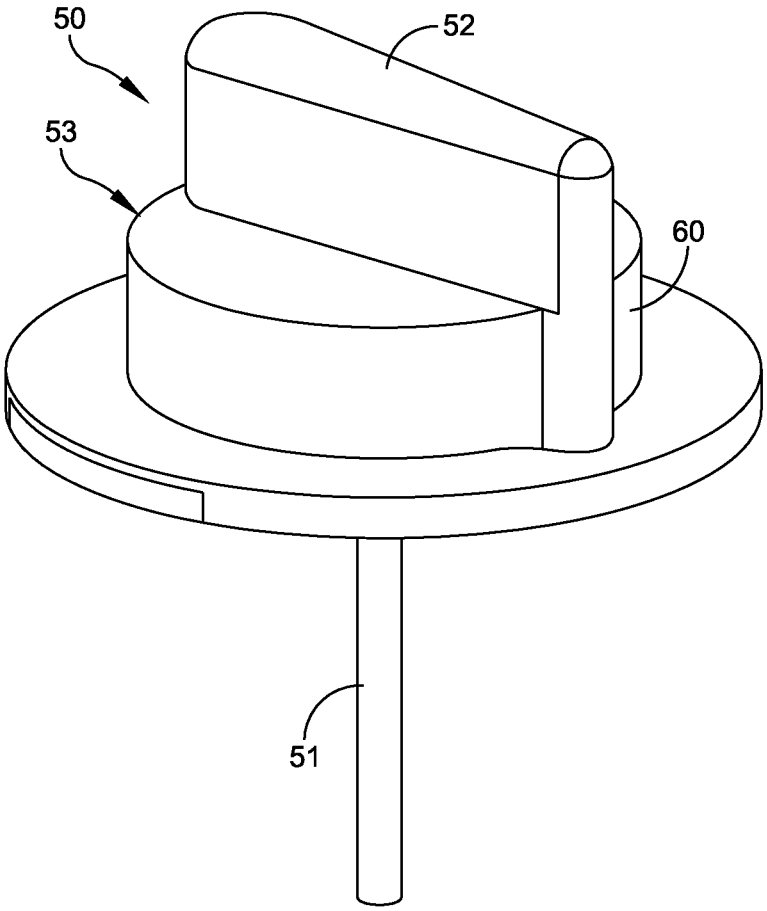
FIG. 5 is a perspective view of a second embodiment of this invention.
Figure 6:
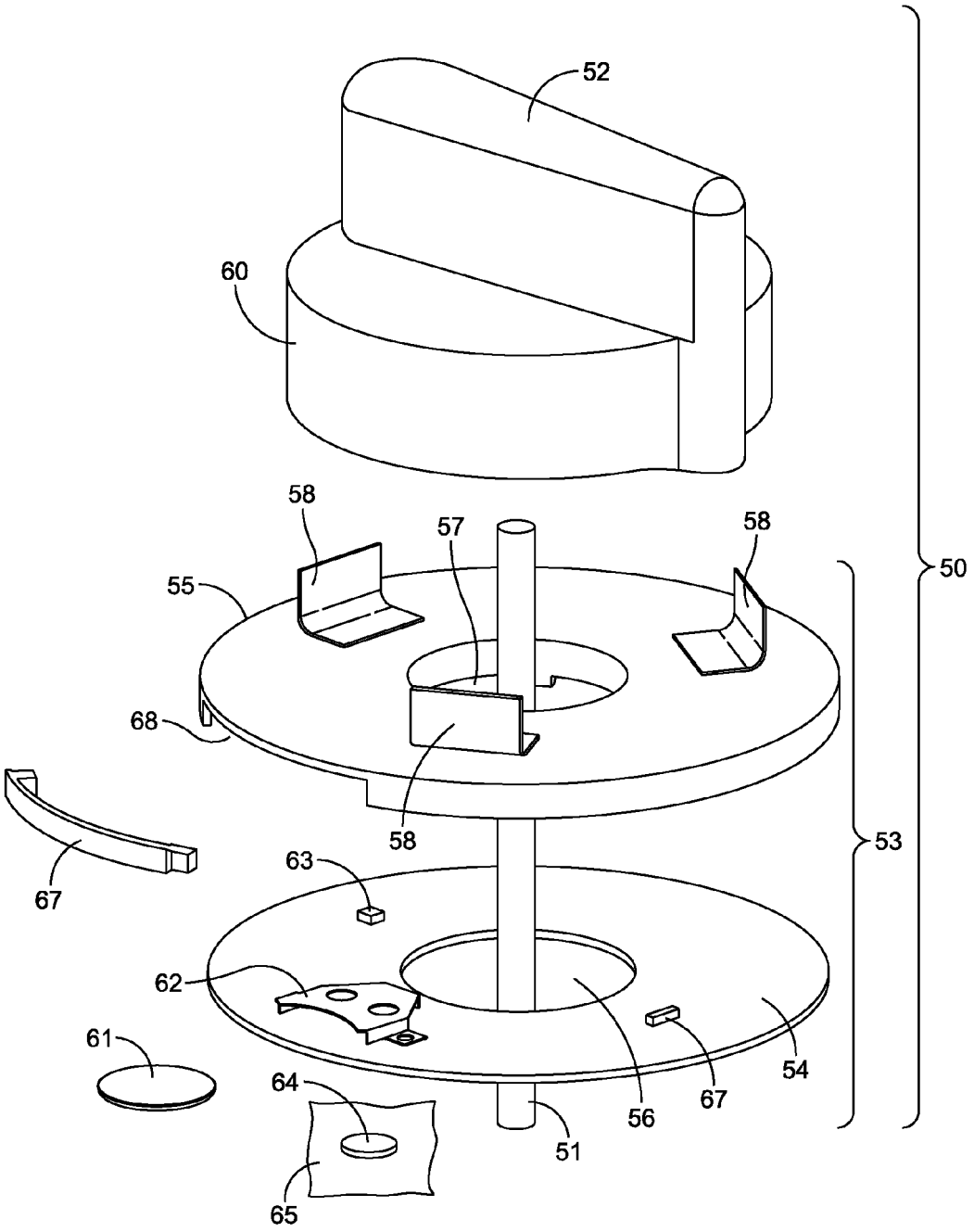
FIG. 6 is an exploded perspective view of the burner control knob in FIG. 5.
Figure 7:
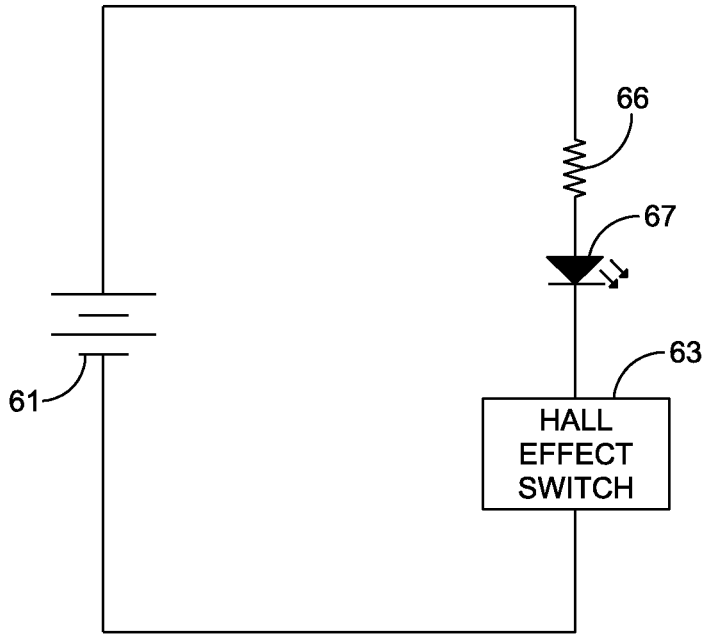
FIG. 7 is a schematic view of the electrical components included in the burner control knob shown in FIGS. 5 and 6.

FIGS. 5 through 7 depict a second embodiment of this invention that provides information such as provided by the embodiment of FIGS. 1 through 4. However, this second embodiment operates with a burner control shaft that may lie along a horizontal, vertical or intermediate axis and enables low-cost manufacturing. This embodiment is also useful as a retrofit or as a knob for use as original equipment in electric or gas stoves. Referring to FIGS. 5 and 6, a control knob 50 attaches to a burner control shaft 51. In this embodiment, the burner control shaft 51 lies along a horizontal axis. The control knob 50 includes an operator 52 that enables an individual to rotate the control knob 50 and a control subassembly 53.

FIG. 6 depicts the control knob 50 with the operator 52, and a control subassembly 53 that includes an annular base plate 54 and an annular cover plate 55. In this particular embodiment, the base plate 54 and the cover plate 55 may be opaque or translucent. Openings 56 and 57 through the base plate 54 and the cover plate 55 respectively, provide a passage for the burner control shaft 51.

The cover 55 includes a plurality of equiangularly spaced L-shaped tabs 58. By way of example, FIG. 6 depicts three such tabs 58. The tabs 58 engage an inner surface of a cylindrical portion 60 of the operator 52 such that rotation of the operator 52 produces corresponding rotation of the base plate 54 and the cover plate 55. Other structures could be substituted. For example, the operator 52, the cover plate 55 and cylindrical portion 60 could be molded as an integral structure.

The attached base plate 54 carries a battery-powered control circuit. Specifically a replaceable battery for 61 mounts in a battery receiver 62 to energize the control assembly through conductors not shown but known in the art and described with respect to FIG. 7. After the battery 61 is located in the receptacle 62, an insert 67 can be inserted into a port 68 to close the cover 55.

The control subassembly 53 in this embodiment is operable in any orientation of the burner control shaft 51. This is achieved by the use of a magnetically responsive switch 63 in combination with a permanent magnet 64 mounted to an exterior surface of a panel 65 adjacent to an opening for receiving the burner control shaft 51. More specifically, the permanent magnet 64 is located so that when the burner control shaft 51 at the "off" position, the magnetically responsive switch 63 is aligned with the permanent magnet 64. Various means can be provided for providing this alignment.

In this particular embodiment, the magnetically responsive switch 63 is a Hall effect switch as a component in the circuit of FIG. 7. In this embodiment, the battery 61 is in a series circuit with a current limiting resistor 66, and LED 67 and the Hall effect switch 63. The Hall effect switch 63 is not conductive in the presence of a magnetic field and is conductive when the switch 63 is remote from the magnetic field as when the control knob moves from the "off" position. Thus, when the burner control shaft 51 is in an "off" position, the Hall effect switch 63 is aligned with and proximate the permanent magnet 64. The resulting field causes the Hall effect switch 63 to shift to a non-conductive state. Consequently the LED 67 is not illuminated. During this state, the load on the battery 61 is minimal as no current passes through the resistor 66 and LED 67. However, when the Hall effect switch 63 rotates away from the permanent magnet 64, the Hall effect switch 63 shifts to a conductive state whereupon the LED 67 turns on producing illumination of the knob if the cover 55 is translucent. When the control knob returns to the "off" position, the proximity of the magnet 64 shifts the Hall effect switch 63 back to the non-conductive state.

Figure 8:
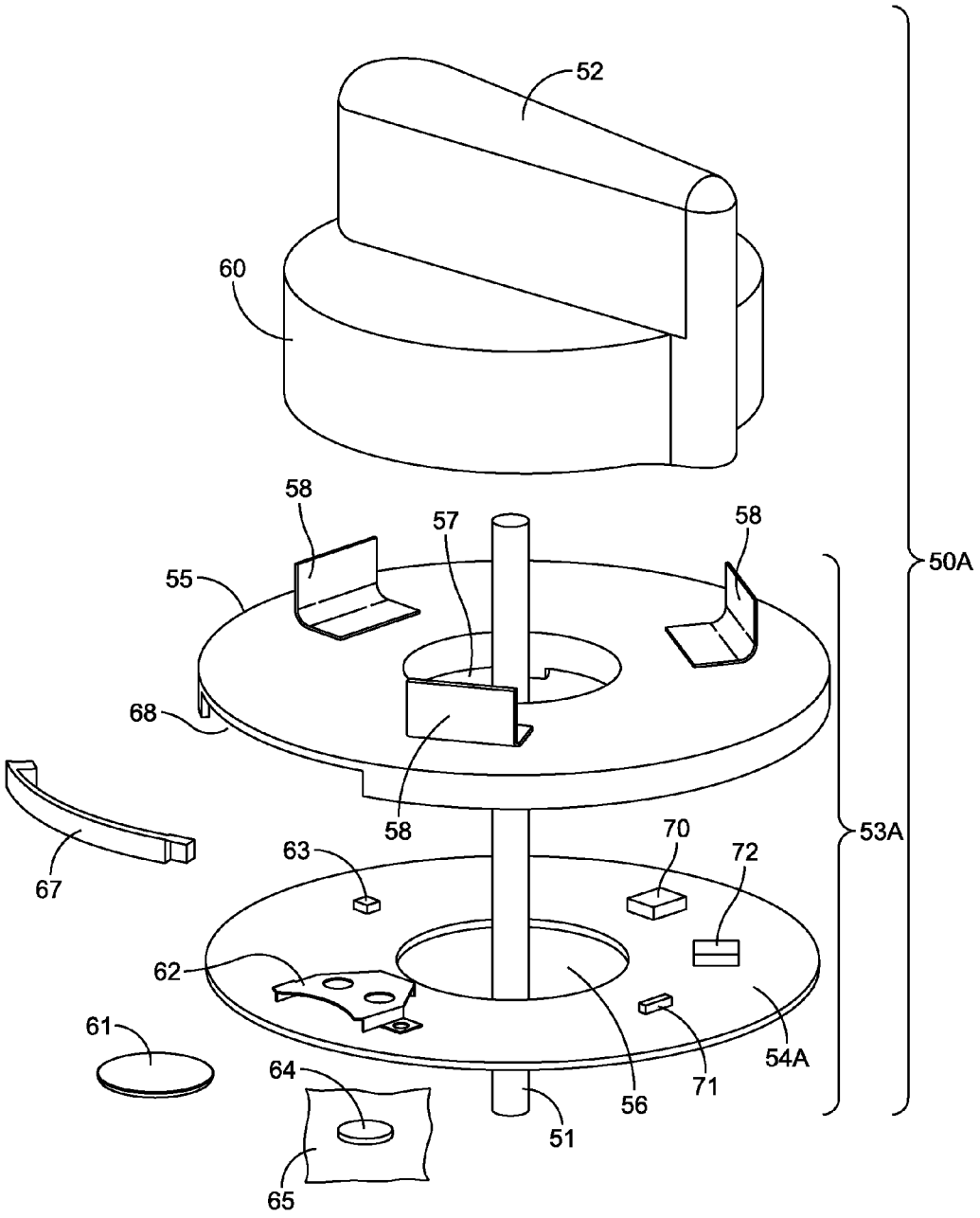
FIG. 8 is an exploded perspective view of a third embodiment of this invention.

FIG. 8 depicts a third embodiment of this invention. Like reference numbers refer to like elements shown in FIG. 6. Specifically, the control knob 50A comprises an operator 52 and a control subassembly 53A. The control subassembly 53A includes a base plate 54A and a cover 55. Like the embodiment of FIG. 6, the control knob 50A in FIG. 8 is adapted for use as a component of an original stove or as a device for retrofitting an existing stove. The control knob 50A is easy to use and is capable of providing a visual or audible annunciation or both.

Like the second embodiment, the base plate 54A carries a battery 61 and a battery receiver 62. The battery 61 provides power to the Hall effect switch 63 and to a programmable microcontroller 70. The microcontroller 70 includes multiple outputs. One output connects to a visual annunciator, such as an LED 71; another output, to an audible annunciator, such as piezoelectric transducer 72 that oscillates in the audio frequency spectrum. As will be apparent, microcontroller 70 could operate with only one of the audible and visual annunciators. When a user rotates the operator 52 and the control subassembly 53 to the "off" position, the battery 61 provides power for a minimal load because the Hall effect switch 63 is not conductive. For example, a microcontroller 70 can enter a "sleep" or equivalent mode to minimize power.

When a user rotates the operator 52 from the "off" position and the Hall effect switch 63 assumes a conductive state, the microcontroller 70 responds to the change in conductivity of the Hall effect switch 63 by initiating an annunciator program that energizes the LED 71 and piezoelectric transducer 72 in predetermined patterns. For example, the annunciator program may define a first pattern of signals for that cause LED 71 to blink or a second pattern the causes the piezoelectric transducer 72 to generate an audible output. Alternatively the patterns could be the same. A given pattern may be generated one time or be repeated over a timing interval. Alternatively, the microcontroller 70 could generate a succession of patterns over time.

When the control knob 50A returns to its "off" position, the microcontroller 70 ceases operation although it may continue to operate to be responsive to the next change of state of the Hall effect switch 63. If the burner is on and the user inspects the stove and decides to extend the time for cooking, the user can decide to rotate the control knob 50A from its current position to the "off" position and then quickly return the control knob 50A to the prior position. This can be incorporated to reset the programs, patterns and timing without affecting the cooking cycle.

Figure 9:
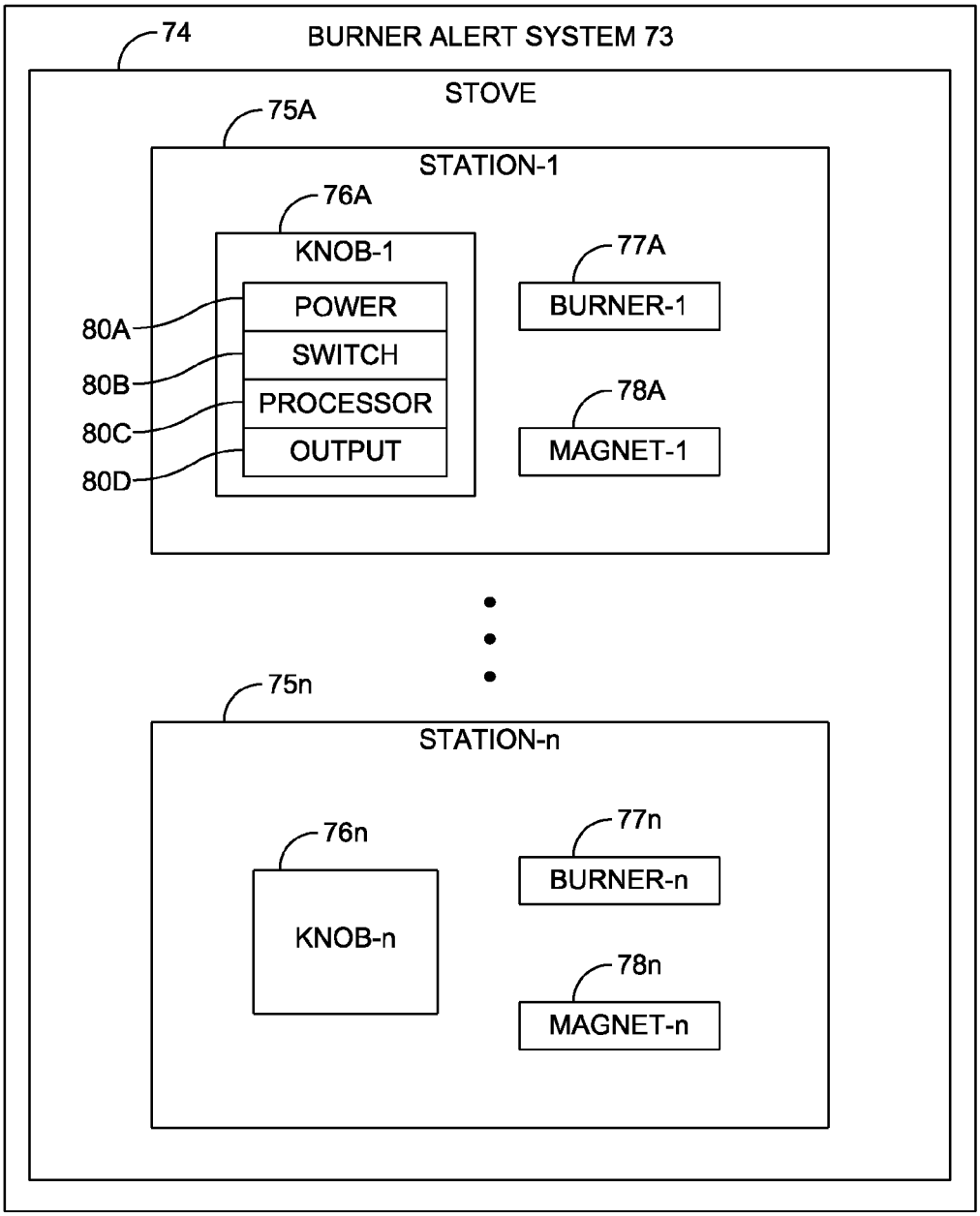
FIG. 9 is block diagram of a burner alert system that incorporates this third embodiment of this invention.

FIG. 9 is a block diagram of a burner alert system 73 for a multi-burner stove 74 containing a plurality of stations. STATION-1 and STATION-n are shown by way of an example. STATION-1, includes a knob 76A, a burner 77A and a magnet 78A corresponding to the permanent magnet 64 in FIG. 8. The knob 76A includes its own power circuit 80A, such as the battery 61, a sensor switch 80B such as the Hall effect switch 63, a processing system 80C such as the microcontroller 70, and an output 80D that connects to an LED 71 and piezoelectric transducer 72. Monitoring is limited to STATION-1 and the general construction of STATION-1 is replicated in all other stations in the stove 74.

Figure 10:
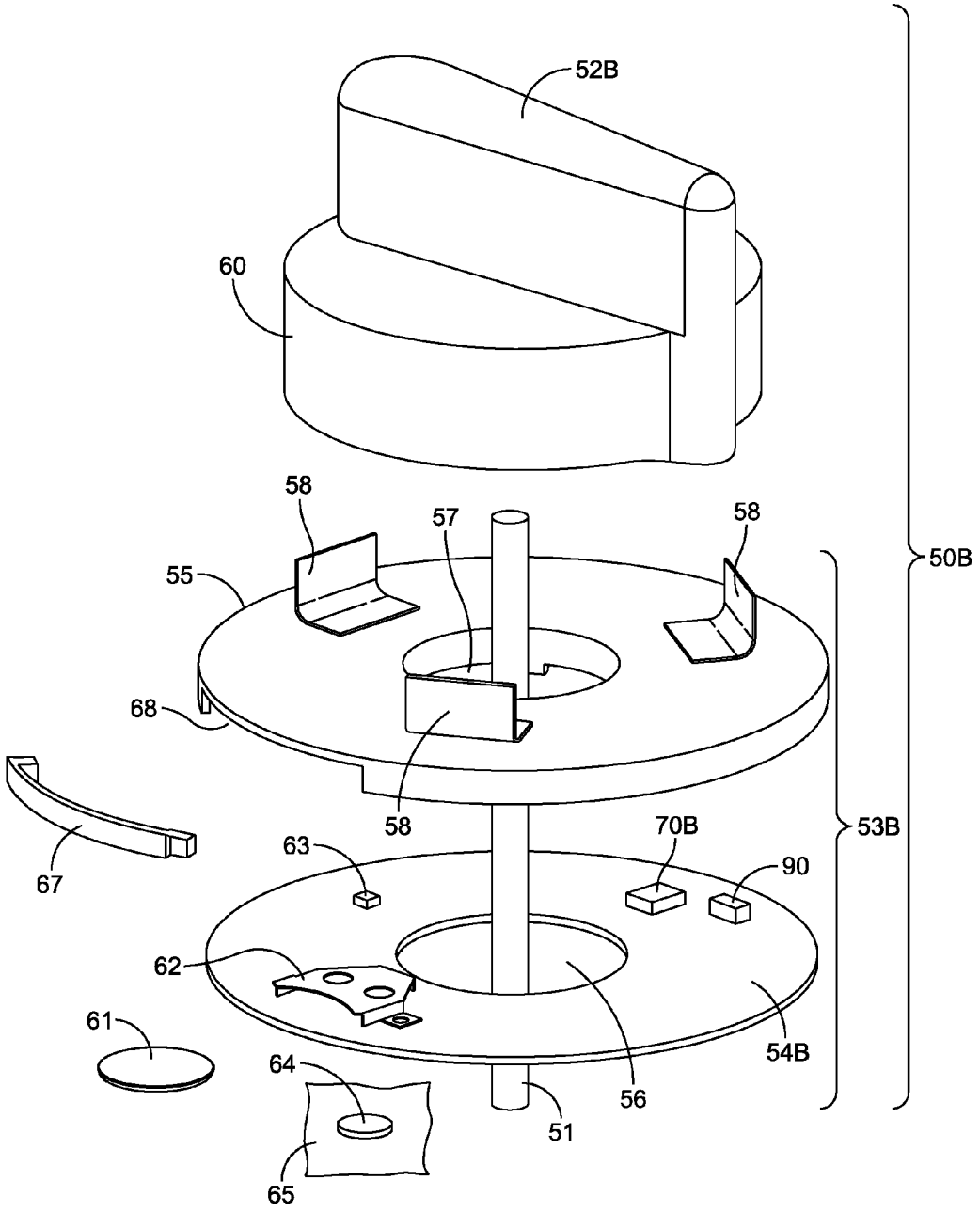
FIG. 10 is an exploded perspective view of a fourth embodiment of this invention.
Figure 11:
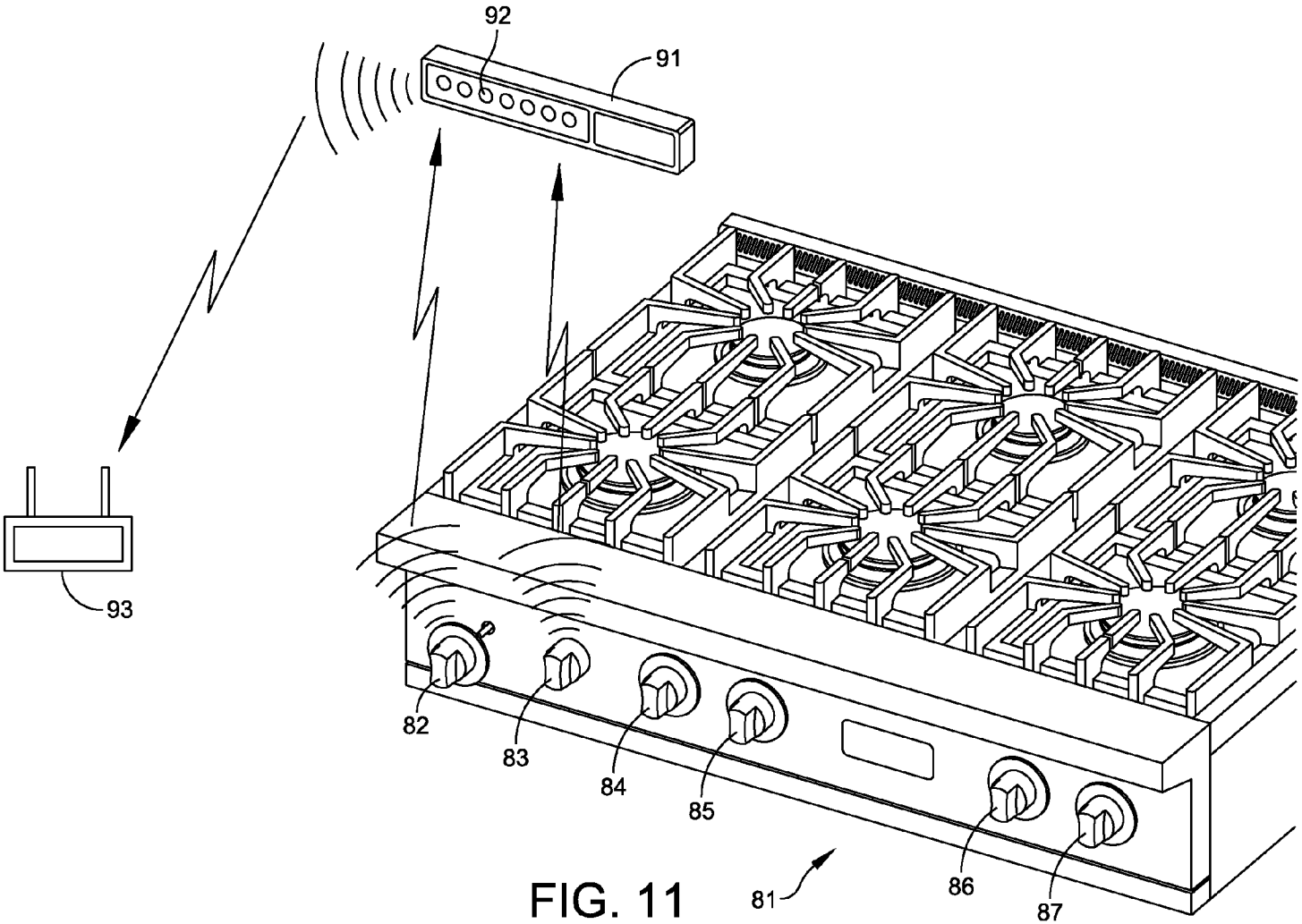
FIG. 11 depicts in block form an example of an implementation of the fourth embodiment.

FIGS. 10 and 11 depict a fourth embodiment of this invention that provides flexibility in response to turning any burner of a multi-burner stove on and off More specifically FIG. 10, depicts a control knob 50B and with an operator 52B and a switching control subassembly 53B. Like the structures in the second and third embodiments of FIGS. 6 and 8, the control knob 50B includes a base plate 54B and a cover 55 located within a cavity defined in the cylindrical portion 60. A battery 61 is located in a battery receiver 62 to provide power to a microcontroller 70B. In this embodiment no structure directly provides a visual or audible annunciation. Rather, a Bluetooth® transceiver 90 is located on the base plate 54B. When the control knob 50B is in the "off" position and the Hall effect switch 63 is aligned with and proximate the permanent magnet 64 for the corresponding burner, the microcontroller 70B transmits a message over such a wireless communications network.

FIG. 11 depicts an implementation of the embodiment of the invention shown in FIG. 10 with a six-burner stove 81 includes six control knobs 82 through 87, each having the same mechanical structure as shown in FIG. 10. The microcontroller in each control knob has a unique address. Upon rotating the control knob 50C away from the "off" position, the microcontroller 70C senses the change of the state of the Hall effect switch 63 and generates a message that identifies the corresponding one of the burner control knobs 82 through 87 that produced the change in the state of the Hall effect switch 63 and the new state. A transceiver, such as a Bluetooth® transceiver, then broadcasts the message.

FIG. 11 depicts a remote annunciator device 91 including a Bluetooth transceiver (not shown). Control circuitry responds to an incoming message by decoding the message and, when the message identifies the fact that the Hall effect switch 63 associated with the origination of the message has moved from the "off" position, provides a visual or audible annunciation. For example, if the message were to identify the burner control knob 94, the annunciator device 91 would activate the associated with a display, such as by illumination of a corresponding LED, such as LED 92.

The annunciator device 91 could also be programmed to transmit a Bluetooth message to another Bluetooth device or compatible WiFi device 93 thereby to communicate with a third party over the Internet or other local network. Each of the annunciator devices, such as the annunciator device 91, could be programmed to respond to a message from the stove 81 providing an unique pattern of signals for each burner.

In summary, there have been disclosed several embodiments of an indicating device for use with stoves to alert a user about conditions of the stove. One embodiment of this indicator device can be readily retrofitted to burner control shafts on existing stoves to provide a visual and/or audible indication of the burner status. The indicator device is easy to use and is adapted for easy installation on a variety of different stoves. It is economical to manufacture and is operable with burner control shafts that lie along horizontal, vertical or intermediate axes. It can be constructed as a standalone device or with a means for enabling remote communications with other devices.

This invention has been disclosed in terms of certain embodiments with certain possible modifications and variations which meet some or all of the objects of this invention. It will be apparent that many other modifications can be made to the disclosed apparatus without departing from the invention. For example, a specific attitude sensing switch has been disclosed. Other attitude sensing switches that provide the conductivity-angular position characteristics of the disclosed attitude sensing switch could be substituted. Therefore, it is the intent of the appended claims to cover all such variations and modifications as come within the true spirit and scope of this invention.

What is claimed is:

1. A stove control assembly, comprising:

an annular base plate having a first surface and a second surface opposite the first surface, a control circuit including a power source located on the first surface, a magnetically responsive switch mounted to the first surface, and at least one indicator mounted to the first surface, the power source, the magnetically responsive switch, and the at least one indicator being connected electrically to one another, and a cover plate having a first surface and a second surface opposite the first surface of the cover plate, the cover plate being attached to the base plate to cover the first surface of the base plate, wherein the stove control assembly is adapted to be attached removably to a stove control knob of a stove that is rotatable from a first position, in which a corresponding stove burner of the stove is deactivated, to a second position, in which the corresponding stove burner is activated, wherein the magnetically responsive switch is adapted to engage magnetically an external magnet mounted to a panel of the stove, wherein when the stove control knob is in its first position, the magnetically responsive switch is aligned with the external magnet and the at least one indicator is deactivated, and wherein when the stove control knob is in its second position, the magnetically responsive switch is unaligned with the external magnet and the at least one indicator is activated.

2. The stove control assembly of claim 1, wherein the base plate includes a central opening extending from the first surface of the base plate to the second surface of the base plate, and the cover plate includes a central opening extending from the first surface of the cover plate to the second surface of the cover plate and aligned with the central opening of the base plate, and wherein the central opening of the base plate and the central opening of the cover plate are each sized and shaped to receive a burner control shaft on which the stove control knob is mounted.

3. The stove control assembly of claim 2, wherein the at least one indicator includes a light emitting diode.

4. The stove control assembly of claim 3, wherein the cover plate includes an outer diameter that is larger than an outer diameter of the stove control knob.

5. The stove control assembly of claim 3, wherein the cover plate includes an outer diameter that is substantially the same as an outer diameter of the stove control knob.

6. The stove control assembly of claim 3, wherein the cover plate is made from a translucent material.

7. The stove control assembly of claim 3, wherein the cover plate is made from a transparent material.

8. The stove control assembly of claim 2, wherein the power source includes a battery.

9. The stove control assembly of claim 8, wherein the base plate includes a receiver mounted on the first surface of the base plate, and wherein the receiver is sized and shaped to receive removably the battery.

10. The stove control assembly of claim 9, wherein the cover plate includes a port aligned circumferentially with the receiver and a port cover attached removably to the port for providing external access to the battery.

11. The stove control assembly of claim 2, wherein the magnetically responsive switch is a Hall effect switch.

12. The stove control assembly of claim 2, wherein the cover plate includes at least one tab mounted on the first surface of the cover plate, and wherein the at least one tab is adapted to engage the stove control knob for attaching removably the stove control assembly to the stove control knob.

13. The stove control assembly of claim 1, wherein the control circuit includes a microcontroller for controlling the at least one indicator.

14. The stove control assembly of claim 13, wherein the at least one indicator includes a piezoelectric transducer.

15. The stove control assembly of claim 14, wherein the at least one indicator includes a light emitting diode.

16. The stove control assembly of claim 15, wherein the control circuit includes a transceiver.

17. The stove control assembly of claim 16, wherein the transceiver is a wireless Bluetooth transceiver.

18. The stove control assembly of claim 17, further comprising a remote indicator that is adapted to communicate with the transceiver.

19. The stove control assembly of claim 1, wherein the panel of the stove is positioned within a horizontal plane.

20. The stove control assembly of claim 1, wherein the panel of the stove is positioned within a vertical plane.

* * * * *